United States Patent [19]

Lindberg

[11] Patent Number: 4,852,326

[45] Date of Patent: Aug. 1, 1989

[54] DUMMY AEROPLANE

[75] Inventor: Christer Lindberg, Gamleby, Sweden

[73] Assignee: Diab-Barracuda AB, Laholm, Sweden

[21] Appl. No.: 186,461

[22] Filed: Apr. 26, 1988

[30] Foreign Application Priority Data

Apr. 29, 1987 [SE] Sweden ..... 8701779

[51] Int. Cl.[4] ..... E04H 3/00

[52] U.S. Cl. ..... 52/745; 244/119; 52/648; 342/4

[58] Field of Search ..... 52/104, 648, 745; 244/119, 120; 324/4

[56] References Cited

U.S. PATENT DOCUMENTS

H000,308 7/1987 Tutin et al. ..... 342/4
2,334,539 11/1943 Buchtel .
2,351,891 6/1944 Weisbaum .
2,360,220 10/1944 Goldman .

FOREIGN PATENT DOCUMENTS 395741 8/1977 Sweden .

*Primary Examiner*—David A. Scherbel
*Assistant Examiner*—Richard E. Chilcot, Jr.
*Attorney, Agent, or Firm*—Lee & Smith

[57] ABSTRACT

The present invention relates to a method for assembling a dummy aeroplane in which a latticework carcass is constructed from the components of an assembly kit and covered with a weatherproof drape. The inventive method is characterized by the sequence of steps in which the upper parts of the carcass, or shell, are assembled at a first level, whereafter the assembled upper part is raised to a second level with the aid of lifting devices and held at this level by the lifting devices while lower parts of the carcass are assembled. These steps are then repeated until the undercarriage of the dummy aeroplane has been fitted, whereafter the lifting devices are withdrawn so that the dummy rests on its wheels, all of this assembly work being carried out at a level suitable for the assembly personnel concerned.

The invention also relates to an assembly kit for carrying out the method.

6 Claims, 4 Drawing Sheets

DUMMY AEROPLANE

The present invention relates to an assembly kit for the construction of a dummy aeroplane, and to a method for assembling the dummy.

It is a tactice of the Air Force to display dummy aircraft on suitable airfields or runways, with the intention of misleading an enemy of the prevailing strength of available aircraft and their locations, and causing the enemy to direct its attack against false targets. In view of the present day constant monitoring of airfields from spy satellites and high flying reconnaissance aircraft it is essential that the dummy aircraft have a good photographic likeness to the real aircraft from above and that the dummy aircraft can be assembled and dismantled quickly, so as not to be kept long in the same location and therewith arouse the suspicions of the enemy. It must also be possible to pack the dummy aircraft into crates or containers and transport the same by road, on water or by air.

The object of the present invention is precisely one of providing a dummy aeroplane which can be assembled and dismantled quickly.

To this end there is proposed in accordance with the invention a method for assembling a dummy aeroplane, in which a carcass or shell of lattice-construction is assembled from the components of an assembly kit and the carcass covered with a waterproof drape, the method being characterized by the steps of assembling upper parts of the carcass, or shell, at a first level; raising the thus assembled carcass to a second level with the aid of lifting devices; holding the carcass at this level with the aid of said lifting devices while lower parts of the carcass are assembled and fitted, and repeating these steps until the aeroplane undercarriage has been fitted, and then withdrawing the lifting means so that the dummy rests on its landing wheels, whereby all of the assembly work is carried out at a height suitable for the assembly personnel. By departing from conventional techniques in which the lower parts of the dummy are assembled first, it is possible to assemble the dummy more quickly than was otherwise the case, partly because it is not necessary to lift the upper carcass parts above the assembled lower carcass parts and partly because the assembly team can work in a comfortable position, even when assembling the upper parts of the carcass.

The invention also relates to an assembly kit for constructing a dummy aeroplane, said kit comprising a multiple of lattice-work modules which are provided at their connection ends with quick-couplings by means of which mutually adjacent modules are connected together to form, from the modules of the assembly kit, a carcass or shell of the type of aeroplane intended; at least three lifting devices which can be attached to upper modules of the carcass; an undercarriage which can be attached to lower modules of the carcass; and drapes of weatherproof material which are intended to be drawn over the assembled carcass such as to cover at least the upper and side surfaces of said carcass.

Such an assembly kit will enable the dummy aeroplane to be assembled quickly, as desired.

These and other features of the invention and advantages afforded thereby will be made apparent in the following detailed description of an exemplifying embodiment of the invention made with reference to the accompanying drawings, in which.

Figure 1:
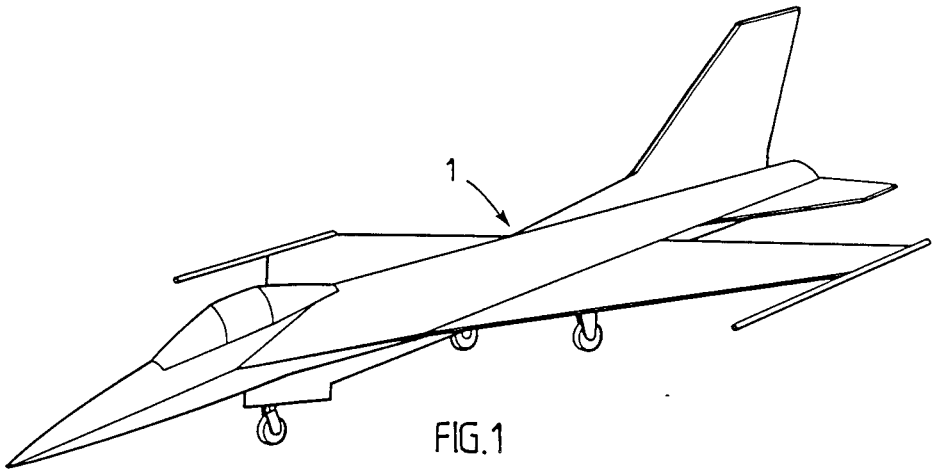
FIG. 1 illustrates a fully assembled dummy aeroplane.
Figure 2:
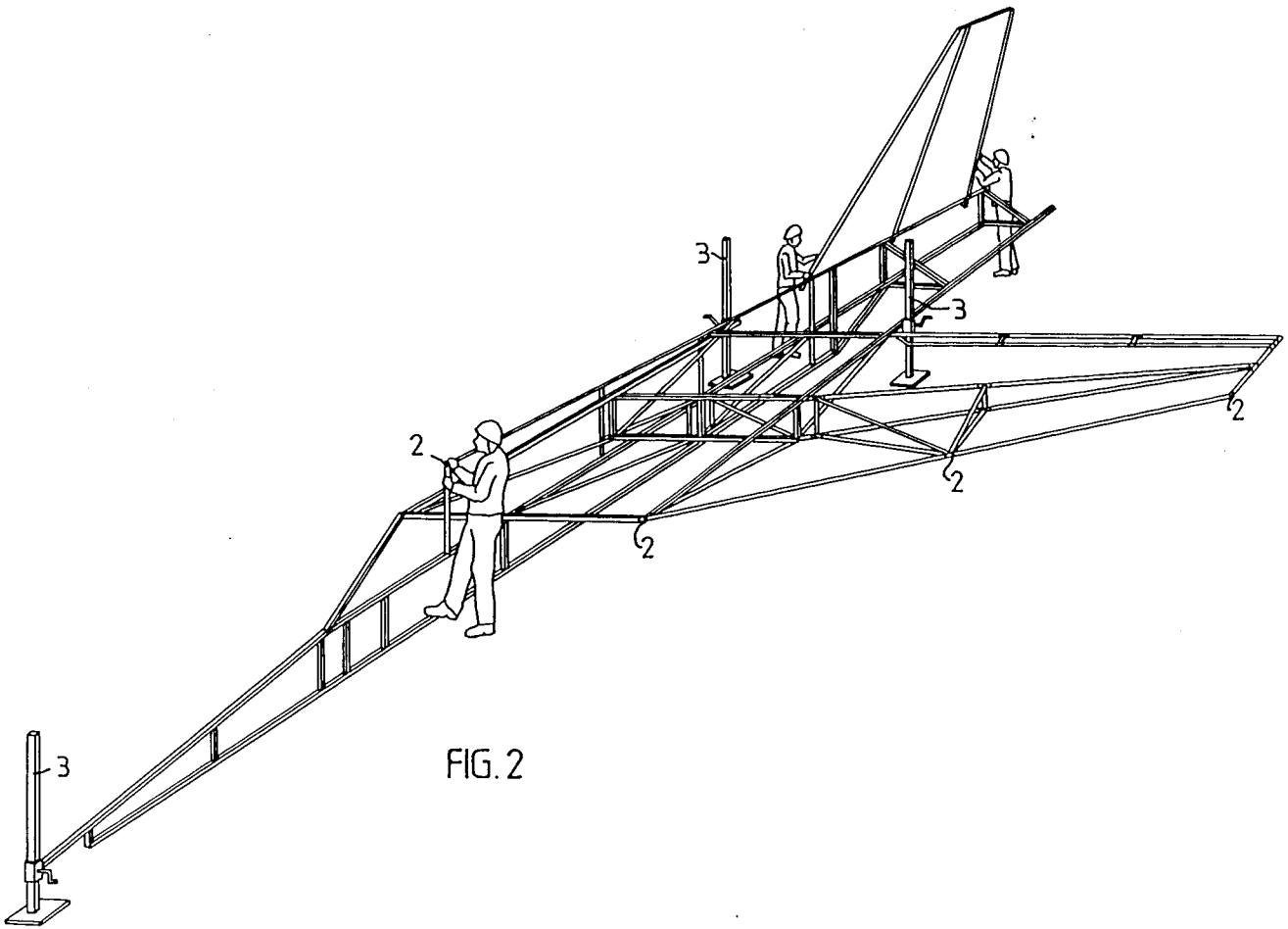
FIG. 2 is a schematic, perspective view of a partially assembled carcass of the dummy illustrated in FIG. 1.
Figure 8A:
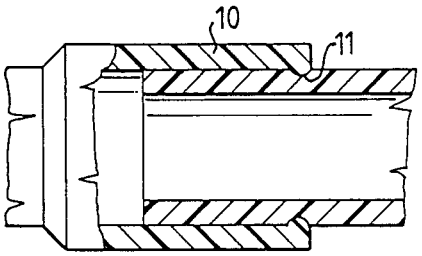
FIGS. 8A and 8B are a partially sectional side view and a cross-sectional view, respectively, of a quick-coupling device which can be used in the embodiments of FIGS. 1–7.
Figure 8B:
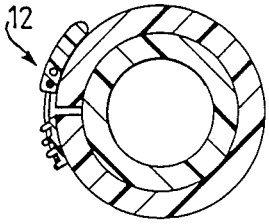

FIGS. 1–4 illustrate an exemplifying embodiment of a dummy aeroplane 1 constructed in accordance with the invention. FIG. 2 illustrates a partially constructed, latticework carcass or shell of the dummy 1. The carcass comprises a plurality of interconnected modules, which are provided with quick-couplings 2 on their connecting ends. The quick-couplings of the illustrated embodiment comprise tubular connecting sleeves and include tightening devices which can be tightened and loosened in a suitable manner by simple manipulations without the aid of tools, e.g. by providing the devices with auxiliary handles. FIGS. 8A and 8B illustrate schematically a quick-coupling including a slitted sleeve 10 cooperating with an end part of an adjacent modul to be connected and provided with a tightening device 12 of the type used on ski-boots. A groove 11 cooperates with an inner rib on the sleeve end. When possible, the kit will contain four-metre modules, so that the carcass can be constructed from as few modules as possible. The lengths of respective modules is limited by the fact that the modules must be easy to handle, and because a packaged assembly kit for transportation may not have excessively large dimensions. In order to enable the four-metre modules to be handled easily, from the aspect of weight, the lattice beams forming the carcass have the form of aluminium profiled sections. The hull of the aeroplane illustrated in FIG. 2 is thus constructed from three four-metre modules.

The assembly kit also comprises three lifting devices 3, which in the illustrated embodiment are attached to the front module and the centre module of the carcass.

The inventive assembly method will now be described primarily with reference to FIGS. 5–7 and with reference to a dummy aeroplane which has a greater height extension than the aeroplane illustrated in FIGS. 1–4 and which therefore requires more stages of assembly. The carcass, or shell, of the dummy illustrated in FIGS. 5–7 is constructed in the same manner as the carcass of the dummy illustrated in FIGS. 1–4.

Figure 5:
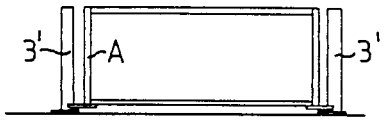
FIGS. 5–7 are views similar to those of FIGS. 3 and 4, but of a dummy aeroplane of a different type to that illustrated i FIG. 1, and illustrate three different stages of assembly.

As illustrated schematically in FIG. 5, the upper modules of the carcass are first coupled to an upper part A. This upper part of the carcass is supported by jacks 3' which are firmly connected to upper modules.

Figure 6:
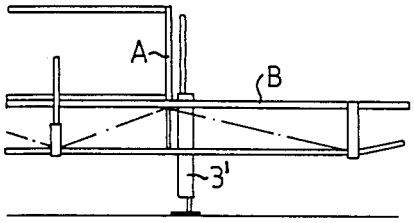

The carcass part A is then raised by the jacks 3' to the position shown in FIG. 6 and the lower modules of the carcass are connected together and to the carcass part A, to form a lower carcass part B.

Figure 7:
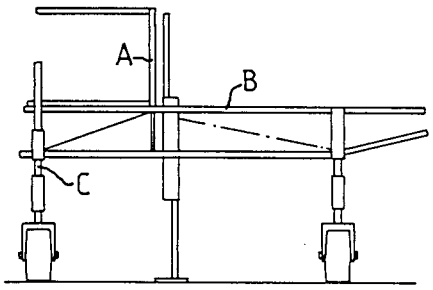

The carcass parts A and B are then raised to the position shown in FIG. 7 and the part C is then fitted, this part C of the present embodiment forming the undercarriage of the dummy aeroplane.

Subsequent hereto, the jacks are lowered to their Figure 5 position in relation to the carcass part A, so that the dummy will rest on its wheels. The thus assembled carcass is covered with a waterproof drape, e.g. a PVC-fabric, and the dummy is ready to be towed to its standing site.

Figure 3:
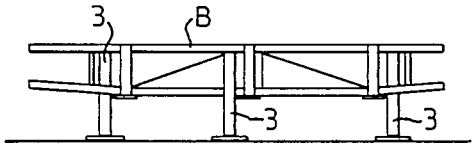
FIGS. 3 and 4 are schematic front views of the carcass of the dummy illustrated in FIG. 1 and illustrate two different stages of assembly.
Figure 4:
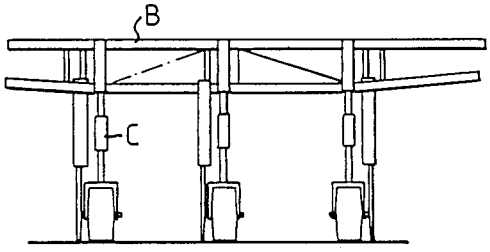

As will be seen from FIGS. 3 and 4, the dummy aeroplane illustrated in FIG. 1 is assembled in a similar manner, but in only two stages, since the dummy of FIG. 1 lacks the upper carcass part A of the dummy illustrated in FIGS. 5–7.

The stabilizer fin or tailplane illustrated schematically in FIG. 2 is conveniently fitted with the drape in place.

Furthermore, the jacks 3′ shown in FIGS. 2–4 are preferably mounted for pivotal movement about a horizontal axis which extends perpendicularly to the longitudinal axis of the carcass, so as to enable the jacks to be swung to one side before covering the carcass with the drape. In this regard, an advantage is afforded when the forwardly located jack, in its out-of-the-way position, forms part of the carcass and is thus included in the nose part of the dummy, whereas the rearwardly located jacks 3′ can be readily lifted up so that their feet lie in the wing portions of the carcass.

Thus, the invention provides a method of assembling a complete dummy aeroplane from an assembly kit in a simple and ready fashion. The construction of the assembled kit enables all stages of the assembly to be carried out at ground level, which in addition to affording comfortable working positions for the assembly team, also reduces the number of heavy lifts in comparison with conventional assembly procedures. The method also lessens the risk of injury to personnel during the work of assembling the dummy. Furthermore, the inventive dummy can be assembled without the use of tools and without the risk of necessary parts, such as jacks and quick-coupling devices, being lost, since these parts form integral parts of the modules included in the assembly kit.

Finally, the invention also enables the dummy aeroplane to be dismantled quickly, this dismantling procedure being effected in the reverse order of the assembling procedure and also including packing the dismantled modules into the assembly kit container. Because the number of modules provided has been reduced to the greatest possible extent, this packaging of the modules can also be carried out quickly.

It will be understood that the described embodiments can be modified in several respects, especially with regard to the construction of the modules. For example, certain modules may be made collapsible, so that they will require less space in their transport state. The invention is therefore only restricted by the contents of the following claims.

I claim:

1. A method for assembling a dummy aeroplane in which a latticework aeroplane carcass is constructed of components from an assembly kit and covered with a weatherproof drape, said carcass consisting of at least one part comprising a plurality of latticework modules connectable to each other, the modules of each of said parts being assembled at the same level, the dummy aeroplane further including an undercarriage having wheels, said parts being assembled one above the other anf fixed to each other when more than one level of said parts is required to form said carcass, the assembled parts being placed above the undercarriage and fixed thereto, said method comprising the steps of (1) assembling a portion comprising at least one said part of the carcass at a first level, (2) subsequently raising the thus assembled portion to a second level with the aid of lifting devices permanently attached to this portion and holding the assembled portion at this second level, (3) assembling another portion comprising at least one said part of the carcass at said first level if said carcass requires more than one level of said parts, (4) subsequently raising the thus assembled portions to said second level with the aid of said lifting devices attached to said first portion if said carcass requires more than one level of said parts, (5) repeating steps (3) and (4) until said carcass is assembled, (6) fitting the undercarriage to a lowermost part of the carcass and then (7) withdrawing the lifting devices so that the dummy rests on its wheels, whereby all assembly work is carried out at a suitable working height for the assembly personnel concerned.

2. A method according to claim 1, in which the assembly kit components are connected together with the aid of quick-coupling devices which include hand-operated tightening means.

3. An assembly kit for constructing a dummy aeroplane, comprising at least an upper portion having at least one part being composed of a plurality of latticework modules which have provided on their respective connecting ends quick-coupling devices for connecting together mutually adjacent modules, said upper portion constituting at least an uppermost part of an aeroplane-carcass which may comprise a plurality of such portions which are placed one above the other and fixed to each other; at least three lifting devices permanently attached to said upper portion and adjustable between a deployed position and a rest position; an undercarriage capable of being attached to the assembled carcass; and weatherproof drapes which are adapted to be drawn over the assembled carcass such as to cover at least the upper and side surfaces thereof, the lifting devices being positionable so as not to protrude outside the contour of an assembled kit in their rest positions.

4. An assembly kit according to claim 3, wherein the modules are constructed from aluminium profiled sections.

5. An assembly kit according to claim 3, wherein the modules are constructed from plastic profiled sections.

6. An assembly kit according to claim 5, in which the sections are reinforced.

* * * * *